US009542817B2

(12) United States Patent
Hummel

(10) Patent No.: US 9,542,817 B2
(45) Date of Patent: Jan. 10, 2017

(54) PERSONAL SAFETY AND SECURITY LIGHT

(71) Applicant: Markus Oliver Hummel, Los Altos Hills, CA (US)

(72) Inventor: Markus Oliver Hummel, Los Altos Hills, CA (US)

( * ) Notice: Subject to any disclaimer, the term of this patent is extended or adjusted under 35 U.S.C. 154(b) by 0 days.

(21) Appl. No.: 14/694,641

(22) Filed: Apr. 23, 2015

(65) Prior Publication Data

US 2015/0310710 A1 Oct. 29, 2015

Related U.S. Application Data

(60) Provisional application No. 61/983,331, filed on Apr. 23, 2014.

(51) Int. Cl.
*G08B 13/14* (2006.01)
*G08B 5/00* (2006.01)
*G08B 15/00* (2006.01)

(52) U.S. Cl.
CPC ..... *G08B 5/002* (2013.01); *G08B 15/004* (2013.01)

(58) Field of Classification Search
None
See application file for complete search history.

(56) References Cited

U.S. PATENT DOCUMENTS 3,832,705 A * 8/1974 King ..... G08B 15/004 340/321
5,001,462 A * 3/1991 Seemann ..... G08B 21/0297 340/574
2008/0276506 A1* 11/2008 McLachlan ..... G09F 7/00 40/541

* cited by examiner

*Primary Examiner* — Brian Zimmerman
*Assistant Examiner* — Cal Eustaquio

(57) ABSTRACT

A personal safety and security light used to deter aggressors, visually and audibly alert people within proximity, and illuminate surrounding areas. The personal safety and security light includes a casing, a plurality of lights, a microcontroller, a sound emitting device, a power supply and a trigger. The plurality of lights is externally mounted on the casing to illuminate the surround area from the casing. The sound emitting device audibly alerts nearby people for help or intervention. The microcontroller conducts power from the power supply to the plurality of lights and the sound emitting device when the trigger completes the circuit. The microcontroller controls the duration, intensity and sequence pattern for the plurality of lights and the sound emitting device. The trigger toggles the circuit open or closed to actuate the microcontroller that begins the sequence for the plurality of lights and the sound emitting device.

9 Claims, 10 Drawing Sheets

PERSONAL SAFETY AND SECURITY LIGHT

The current application claims benefit of U.S. Provisional Patent application Ser. No. 61/983,331 filed on Apr. 23, 2014.

FIELD OF THE INVENTION

The present invention relates generally to a personal safety device. More specifically, the present invention is a non-violent means to deter aggressors in during the night hours though the use of audible and visual alerts.

BACKGROUND OF THE INVENTION

Many attacks occur using the cover of darkness during non-daylight hours. Aggressors believe it's easier to prey on their victims in low light areas, making it hard to identify them or having a more subtle approach to the victim. A need for a personal safety device that allows for users to protect themselves from aggressors that may be more physically capable than they are is necessary. Personal security devices give you peace of mind and protect you when needed. Personal security devices need to be small enough to fit into your personal life so that they can be carried anytime and anywhere. There are several means of protection that are intended to be used when the aggressor strikes, such as pepper spray, electric shock devices, or other implements to fend off the aggressor as they are assaulting there victim. Most methods are used when the aggressor is striking and may not be accessible or may be obvious to the aggressor when drawn. Extremely bright light has been proven to be an effective non-lethal and legal "weapon" to temporarily blind an aggressor and in order to get away or draw attention from rescuers. A very bright light disorients and readjusts the aggressor's vision in the cover of darkness and illuminating the area to increase the odds of identifying the aggressor.

Therefore, it is an object of this invention to present a device that allows the user to conceal a portable alarm device that deters aggressors before or during an attack through the use of light and sound. The personal safety and security light is golf-ball sized and has a rip-cord, which doubles as a key chain. If the rip-cord is pulled an internal timer is triggered and within seconds about a dozen super bright light emitting diode (LED) lights spread throughout the outside of the ball, blasting blinding light with incredible brightness. That light can be used against oncoming aggressors to blind them and also to cause attention alerting bystanders to come for rescue, decreasing the risk of an attack and increasing the odds of evading the aggressor.

DETAIL DESCRIPTIONS OF THE INVENTION

Figure 1:
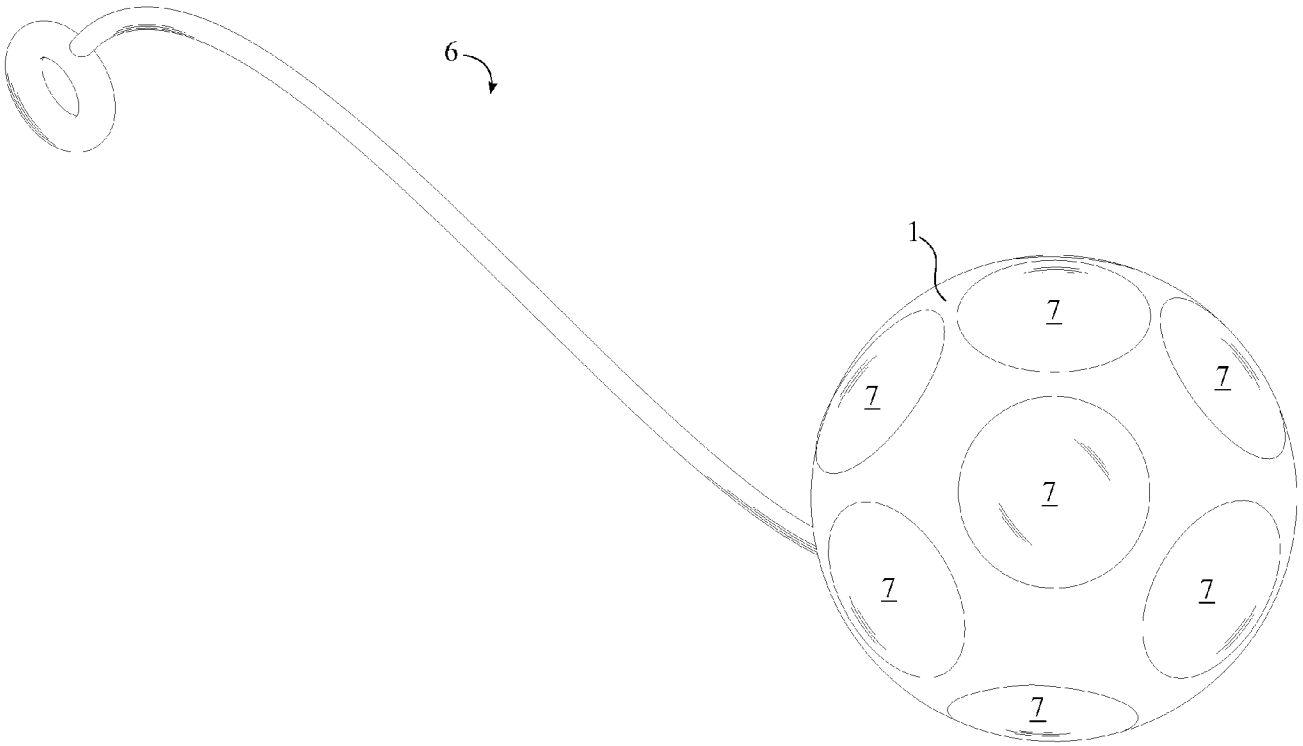
FIG. 1 is a perspective view of the preferred embodiment of the present invention having the ripcord extended.
Figure 2:
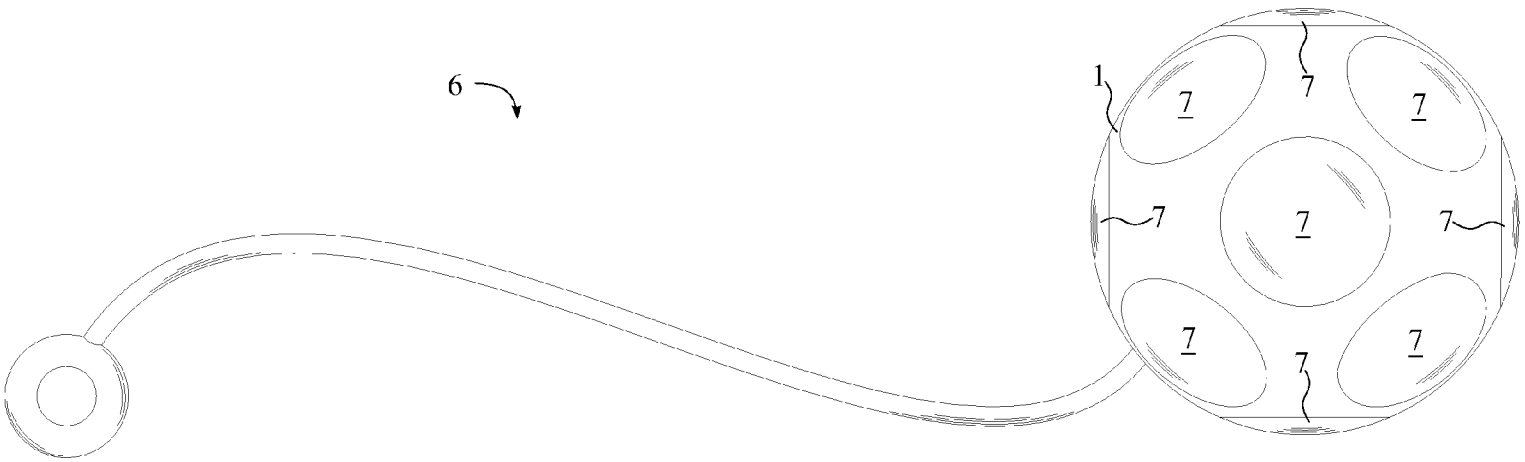
FIG. 2 is a side view of the preferred embodiment of the present invention having the ripcord extended.
Figure 3:
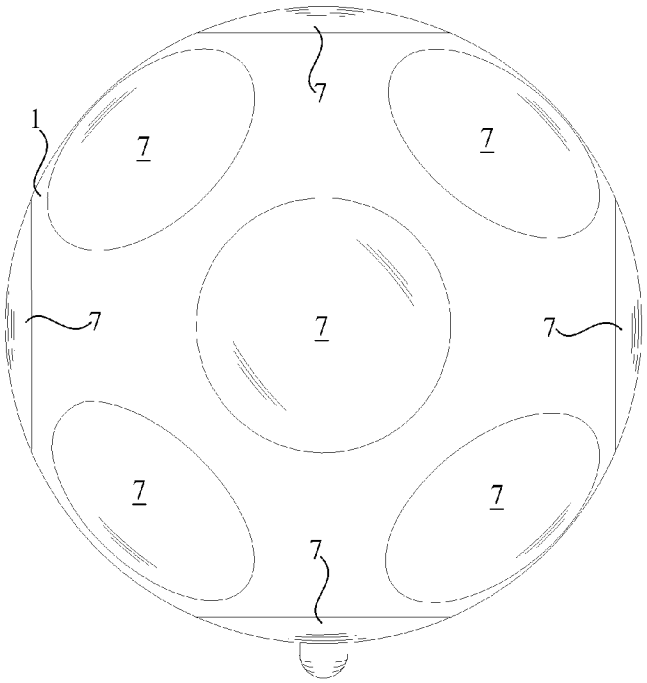
FIG. 3 is a front view of the preferred embodiment of the present invention.
Figure 4:
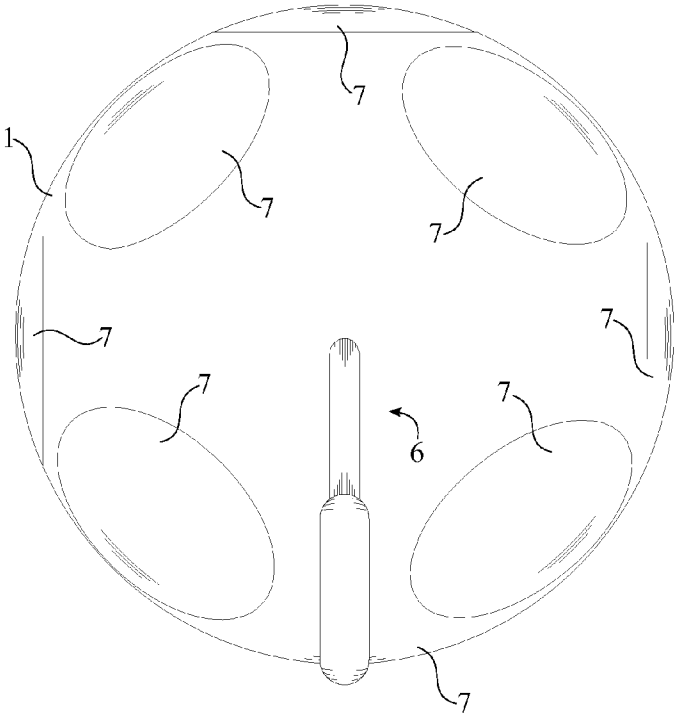
FIG. 4 is a rear view of the preferred embodiment of the present invention having the ripcord slightly extended.
Figure 5:
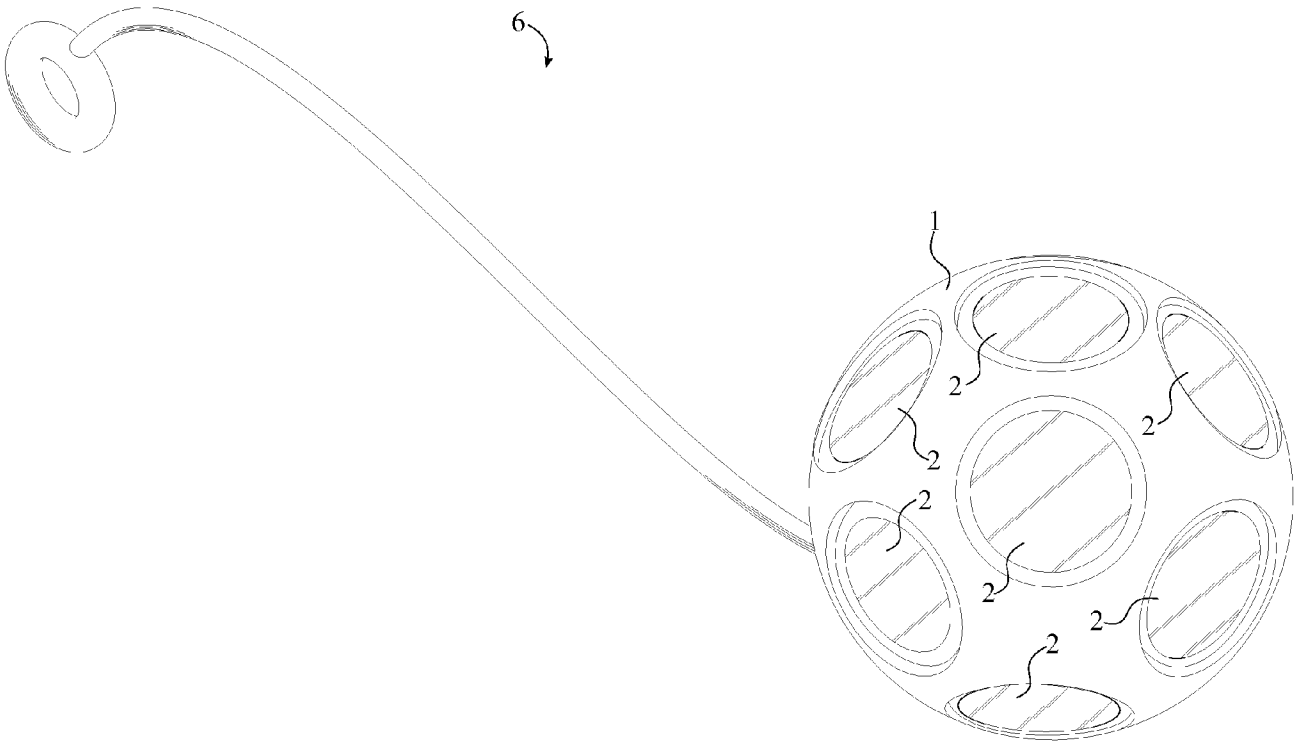
FIG. 5 is a perspective view of the preferred embodiment of the present invention having the plurality of translucent light covers removed.

All illustrations of the drawings are for the purpose of describing selected versions of the present invention and are not intended to limit the scope of the present invention.

The present invention is a personal safety and security light which allows users to defend themselves and cause a distraction to evade aggression from aggressors, as shown in FIG. 1 to FIG. 5. It is an object of the present invention to provide a device that assists in personal protection specifically in the night hours. The personal safety and security light brings attention to the device by emitting bright lights and audible alerts to disorient the aggressor or to alert nearby persons to assist and intervene in the situation. One embodiment of the present invention allows for the present invention to be easily concealable, due being approximately the size of a golf ball, and accessible within a pocket of a garment or attached to a keychain. Alternate shapes and sizes for the personal safety and security light include, but are not limited to baseball, a soda can, or any other similarly appropriate shape and size within the spirit of the present invention.

In accordance to FIG. 6 to FIG. 9, the present invention comprises a casing 1, a plurality of lights 2, a sound emitting device 4, a microcontroller 3, a power supply 5, and a trigger 6. The casing 1 houses the electronic component such that they do not get damaged through operation of the present invention. The plurality of lights 2 and the sound emitting device 4 alert nearby persons as well as surprising and disorienting aggressors through unexpected light and sound alerts. The microcontroller 3 controls the duration and pattern of light and sound alerts. The power supply 5 provides electrical power to the electrical components of the present invention. The trigger 6 initiates a sequence to play the audible and visual alerts of the present invention when actuated. The plurality of lights 2 is externally mounted about the casing 1 in order to optimize luminosity output from the present invention. The plurality of lights 2 and the sound emitting device 4 are electronically connected to the microcontroller 3. The microcontroller 3 is electrically connected to the power supply 5 to distribute power to the microcontroller 3 and subsequently to the plurality of lights 2 and the sound emitting device 4 through the microcontroller 3. The trigger 6 is electronically connected to the microcontroller; however, the trigger 6 can vary between different embodiments of the present invention.

In accordance to the preferred embodiment, the casing 1 is a spherical shape such that the present invention can be easily thrown, launched, or rolled by the user. The plurality of lights 2 is radially distributed about the casing 1 such that the present invention provides an emission of light regardless of the orientation of the present invention.

Due to the capability of being thrown or launched, an important aspect of the present invention is to protect the plurality of lights 2 such that the plurality of lights 2 does not become damaged on impact. Therefore, the preferred embodiment of the present invention further comprises a plurality of translucent light covers 7. The plurality of translucent light covers 7 protects the plurality of lights 2 from external damage as the plurality of translucent light covers 7 is externally mounted on the casing 1. Each of the plurality of lights 2 is positioned between a corresponding cover of the plurality of translucent light covers 7 and the casing 1 to protect the plurality of lights 2 from impact and other external hazards.

Figure 6:
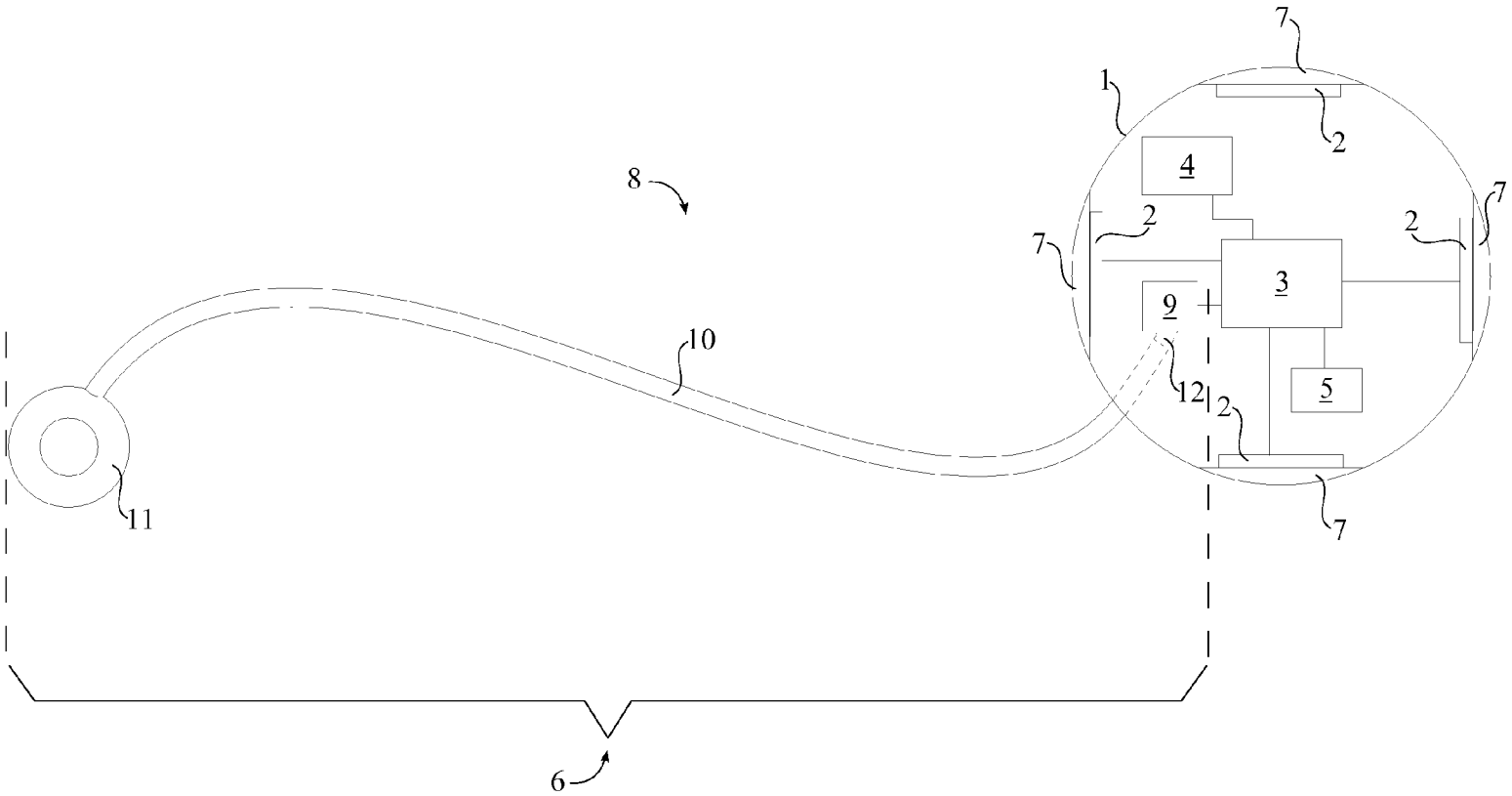
FIG. 6 is a schematic of the electrical connections of the present invention, wherein the trigger is a ripcord.
Figure 7:
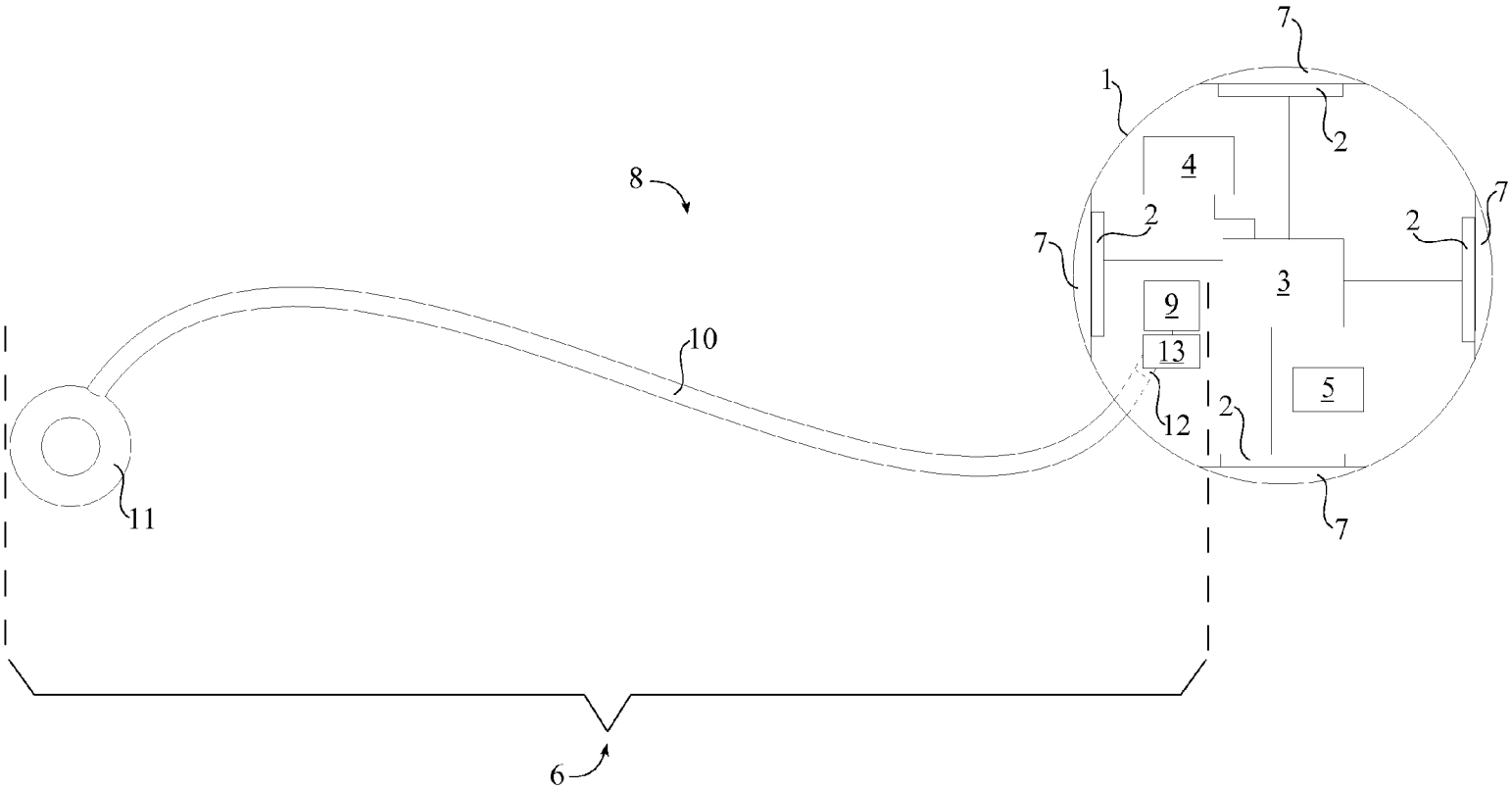
FIG. 7 is a schematic of the electrical connections of the present invention, wherein the trigger is a ripcord implementing the retraction mechanism.
Figure 10:
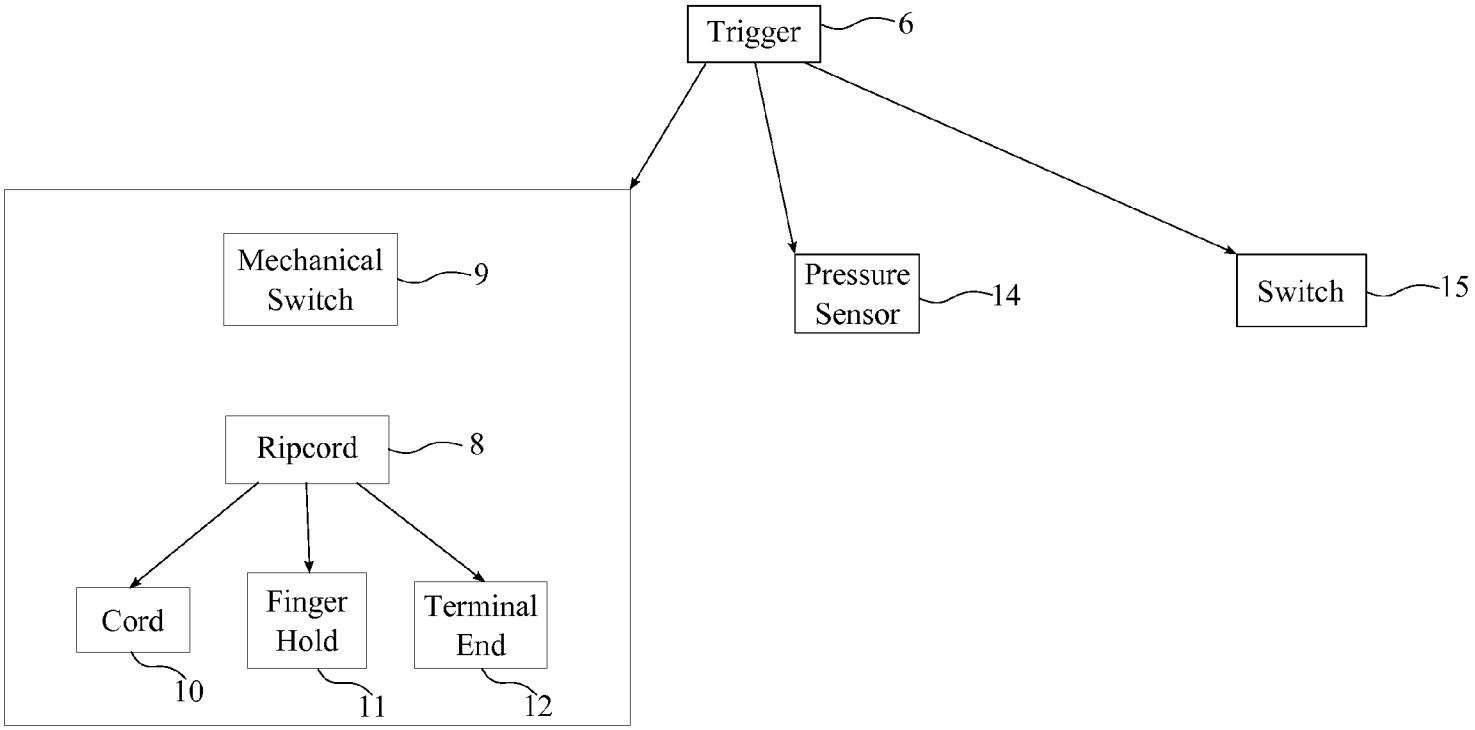
FIG. 10 is a block diagram exemplifying possible embodiments for the trigger.

As the present invention is intended to be a personal safety device, the present invention is purposefully activated by the user. To activate the present invention, the user engages the trigger 6. The selected trigger 6 depends on the user's desired purpose: deterring aggressors; attracting the attention of nearby people; or illuminating surrounding areas. A circuit allows a current to flow from the power supply 5 through the microcontroller to plurality of lights 2 and the sound emitting device 4 when the trigger 6 is actuated to complete the circuit. To deter aggressors, the trigger 6 is preferred to comprise a ripcord 8 and a mechanical switch 9, as shown in FIG. 6, FIG. 7 and FIG. 10. Pulling the ripcord 8 activates the plurality of lights 2 and the sound emitting device 4 through the mechanical switch 9. The ripcord 8 comprises a cord 10 and a finger hold 11. The cord 10 traverses out of the casing 1. A terminal end 12 of the cord 10 is operatively coupled to the mechanical switch 9 as the mechanical switch 9 is electrically connected to the microcontroller 3 and is positioned within the casing 1, such that the casing 1 protects the mechanical switch 9 from accidental activation. The finger hold 11 allows the user to actuate the mechanical switch 9 with greater ease. The finger hold 11 and the terminal end 12 are positioned opposite each other along the cord 10, such that the finger hold 11 is positioned external to the casing 1.

In some embodiments, the terminal end 12 is detachably tethered to the mechanical switch 9 such that when the mechanical switch 9 is pulled onto an activation spot where the circuit is completed to activate the routine which controls the plurality of lights 2 and the sound emitting device 4. The user is able to insert a finger into the finger hold 11 and throw the present invention, separating the ripcord 8 from mechanical switch 9, and therefore the casing 1, as tension is drawn on the cord 10. Thus, the user is able to activate and locate the present invention within throwing proximity of the user to alert nearby people or to distract an aggressor. Since the ripcord 8 is completely separated from the mechanical switch 9, the alternative embodiment with the detachable ripcord 8 is considered to be disposable.

In other embodiments, the present invention comprises a retraction mechanism 13 to allow the present invention to be re-useable, as shown in FIG. 7. The retraction mechanism 13 is positioned within the casing 1. The terminal end 12 of the ripcord 8 is permanently attached to the retraction mechanism 13 such that when the ripcord 8 is pulled, the mechanical switch 9 completes the circuit after a predetermined amount of the ripcord 8 is pulled through the casing 1. Once the user lets go of the ripcord 8, the ripcord 8 is immediately pulled back into the casing 1 through the retraction mechanism 13. Alternately, the retraction mechanism 13 locks the ripcord 8 in the extended position. When the user needs to recoil the ripcord 8 back into the casing 1, the user needs to pull the ripcord 8 slightly so that the ripcord 8 can be released into the casing 1. The retraction mechanism 13 includes, but is not limited to, a tape spring, spring coils, or other appropriate means of retracting a cord 10 or string-like object. After use, the present invention may be recovered and re-used at a later time. Applications for these other embodiments include, but are not limited to, sea diving, maintenance work and repair, or any other situation to illuminate spaces where a typical flashlight may not fit though or be inconvenient to maneuver or orient.

Figure 8:
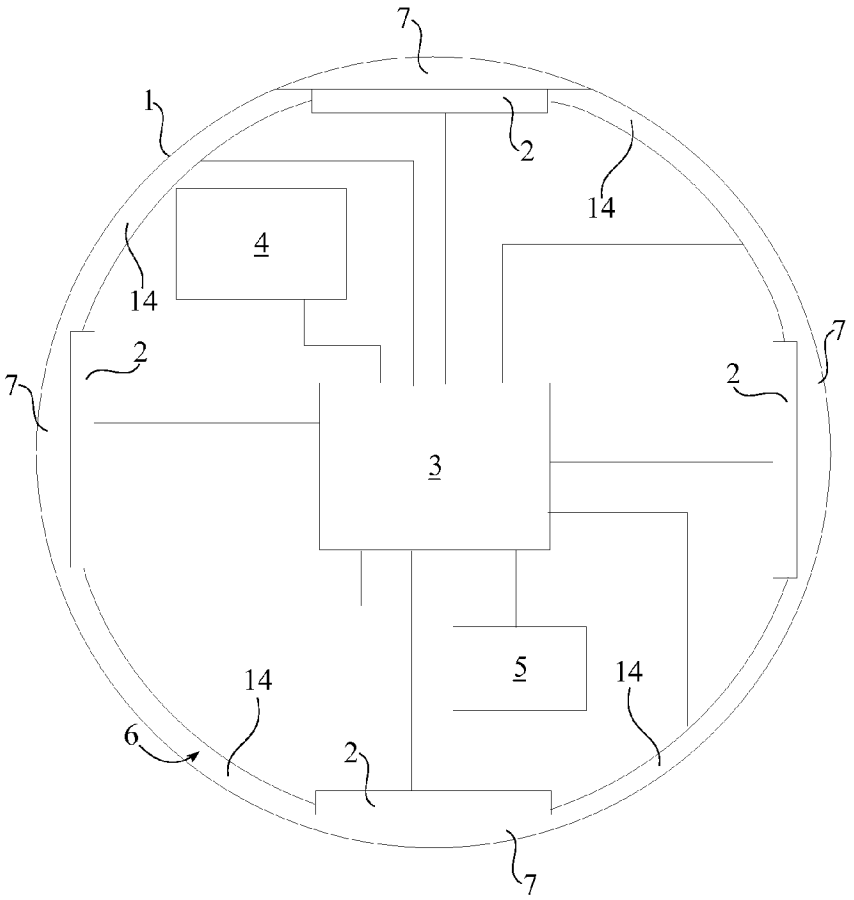
FIG. 8 is a schematic of the electrical connections of the present invention, wherein the trigger is a pressure sensor.

In some alternate embodiments, the trigger 6 comprises a pressure sensor 14, as detailed in FIG. 8 and FIG. 10. The pressure sensor 14 is internally mounted about the casing 1. The pressure sensor 14 is electronically connected to the microcontroller 3. The pressure sensor 14 sends a digital signal to the microcontroller 3 which subsequently activates the plurality of lights 2 and the sound emitting device 4 when any significant impact onto the casing 1 reduces the resistance within pressure sensor 14 or completes the circuit when pressure is applied. In these alternate embodiments, the present invention can be thrown or launched, and when the present invention impacts a rigid body with sufficient force, the plurality of lights 2 and the sound emitting device 4 would be triggered. These alternative embodiments of the present invention may be used in tactical entrance situations. For example, the present invention is thrown into the room for entrance. When the present invention impacts a wall or floor, the plurality of lights 2 emits a blinding light or light pulses to disorient the visions of persons within the room, while the sound emitting device 4 outputs an auditory disorienting alert to mask movements of law enforcement into a room. The present invention may see applications in law-enforcement, counter-terrorist units, or the military. The present invention is able to be launched through the use of specially designed launchers such that the present invention is able to be launched farther distances than a person may be able to throw. Thus, providing better and more advantageous vision in dark houses, alleyways, caves or similar situations without the danger of setting the area on fire, as possible with the use of flares.

Figure 9:
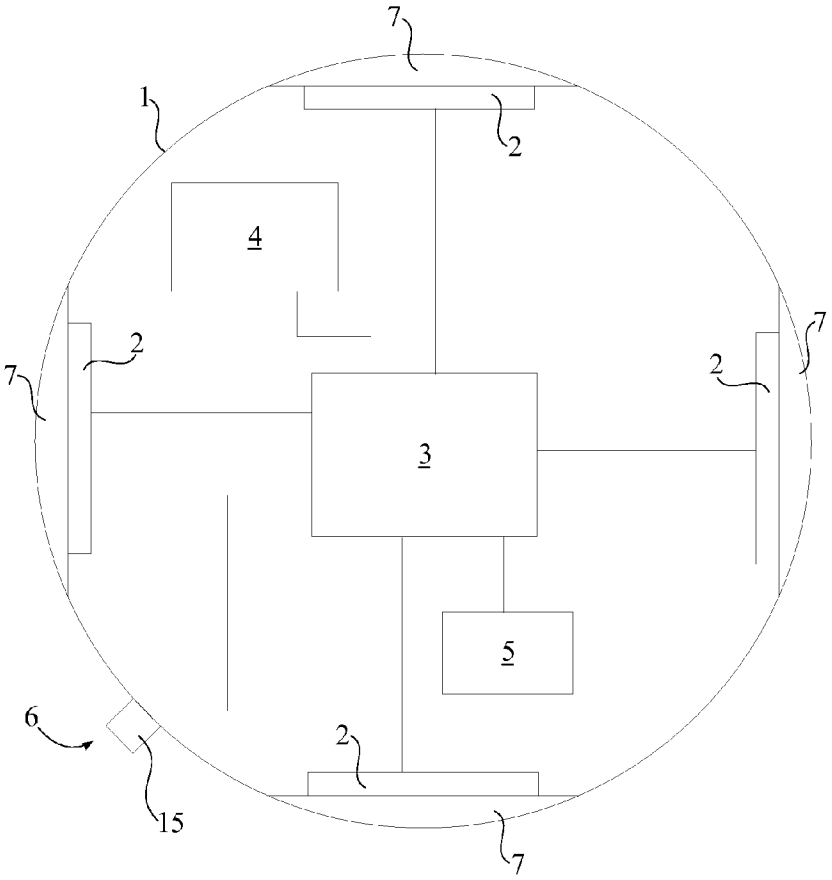
FIG. 9 is a schematic of the electrical connections of the present invention, wherein the trigger is an external switch.

In other alternate embodiments, the trigger 6 comprises a switch 15 for the user to toggle the present invention on and off, in accordance to FIG. 9 and FIG. 10. The switch 15 toggles the circuit open or closed which initiates the plurality of lights 2 and the sound emitting device 4. The switch 15 is externally mounted on the casing 1 and electronically connected to the microcontroller 3. The user can purposefully toggle the circuit closed to activate the plurality of lights 2 and the sound emitting device 4. Similar to the embodiment including the retractable ripcord 8, applications for these other embodiments include, but are not limited to, sea diving, maintenance work and repair, or any other situation to illuminate spaces where a typical flashlight may not fit though or be inconvenient to maneuver or orient.

In some embodiments utilized for sea diving, the casing 1 is watertight and able to withstand typical diving pressures. Further in accordance to these embodiments, the sound emitting device 4 is adapted to transfer sound through water. In some embodiments, the density of the present invention is varied such that the present invention either has a high density, where the present invention sinks, or a low density where the present invention floats on a body of water. A high density allows divers to drop or place the present invention on surfaces for illuminating an area such as an underwater cave. A low density provides divers with a beacon to alert nearby ships or passing aerial vehicles to the location where a diver may surface or emergency assistance is needed.

As previously mentioned, the microcontroller 3 is able to control the duration, sequencing, and intensity for both the plurality of lights 2 and the sound emitting device 4. The microcontroller 3 is preset depending on the application or toggled by the user between predetermined alert emissions. The plurality of lights 2 is set to a continuous, pulsing/strobe or variable emissions of light. Continuous light emission is preferred in maintenance situations and other situations where uninterrupted light is necessary. Pulsing/strobe and variable light emissions are preferred when visual disorientation is desired. Similarly, the sound emitting device 4 is set a continuous, pulsing/strobe, or variable emissions of sound. The plurality of lights 2 is preferred to be light emitting diodes (LED); however, the plurality of lights 2 includes any other highly luminous lightbulb suitable for the application of the present invention. The visual and audible alerts are programmed such that the alert is required to last for at least a minimum duration so the aggressor cannot disable the alert easily.

Although the invention has been explained in relation to its preferred embodiment, it is to be understood that many other possible modifications and variations can be made without departing from the spirit and scope of the invention as hereinafter claimed.

What is claimed is:

1. A personal safety and security light comprises:
a casing;
a plurality of lights;
a microcontroller;
a sound emitting device;
a power supply;
a trigger;
the plurality of lights being externally mounted about the casing;
the microcontroller, the sound emitting device, and the power supply being positioned within the casing;
the plurality of lights, the sound emitting device, and the trigger being electronically connected to the microcontroller;
the microcontroller being electrically connected to the power supply;
a plurality of translucent light covers;
the plurality of translucent light covers being externally mounted on the casing;
each of the plurality of lights being positioned between a corresponding cover from the plurality of translucent light covers and the casing;
the casing is a spherical shape;
the plurality of lights is radially distributed about the casing;
the trigger comprises a pressure sensor;
the pressure sensor being internally mounted to the casing;
the pressure sensor being electronically connected to the microcontroller;
the trigger comprises a switch;
the switch being externally mounted on the casing; and
the switch being electronically connected to the microcontroller.

2. The personal safety and security light as claimed in claim 1 comprises:
the trigger comprises a ripcord and a mechanical switch;
the ripcord comprises a cord and a finger hold;
the cord traversing out of the casing;
the finger hold and a terminal end of the cord being positioned opposite to each other along the cord;
the terminal end being operatively coupled to the mechanical switch, wherein the terminal end actuates the mechanical switch; and
the mechanical switch being electronically connected to the microcontroller.

3. The personal safety and security light as claimed in claim 2 comprises:
a retraction mechanism;
the retraction mechanism being positioned within the casing; and
the terminal end being permanently tethered to the retraction mechanism.

4. The personal safety and security light as claimed in claim 2, wherein the terminal end is detachably tethered to the mechanical switch.

5. A personal safety and security light comprises:
a casing;
a plurality of lights;
a microcontroller;
a sound emitting device;
a power supply;
a trigger;
a plurality of translucent light covers;
the plurality of lights being externally mounted about the casing;
the microcontroller, the sound emitting device, and the power supply being positioned within the casing;
the plurality of lights, the sound emitting device, and the trigger being electronically connected to the microcontroller;
the microcontroller being electrically connected to the power supply;
the plurality of translucent light covers being externally mounted on the casing;
each of the plurality of lights being positioned between a corresponding cover from the plurality of translucent light covers and the casing;
the trigger comprises a ripcord and a mechanical switch;
the ripcord comprises a cord and a finger hold;
the cord traversing out of the casing;
the finger hold and a terminal end of the cord being positioned opposite to each other along the cord;
the terminal end being operatively coupled to the mechanical switch, wherein the terminal end actuates the mechanical switch;
the mechanical switch being electronically connected to the microcontroller;
a retraction mechanism;
the retraction mechanism being positioned within the casing;
the terminal end being permanently tethered to the retraction mechanism; and
the terminal end is detachably tethered to the mechanical switch.

6. The personal safety and security light as claimed in claim 5, wherein the casing is a spherical shape.

7. The personal safety and security light as claimed in claim 5, wherein the plurality of lights is radially distributed about the casing.

8. The personal safety and security light as claimed in claim 5 comprises:
the trigger comprises a pressure sensor;
the pressure sensor being internally mounted to the casing; and
the pressure sensor being electronically connected to the microcontroller.

9. The personal safety and security light as claimed in claim 5 comprises:
the trigger comprises a switch;
the switch being externally mounted on the casing; and
the switch being electronically connected to the microcontroller.

* * * * *